United States Patent [19]

Shivers

[11] Patent Number: 4,545,493

[45] Date of Patent: Oct. 8, 1985

[54] CONTAINER AND CLOSURE WITH TAMPER INDICATING MEANS

[76] Inventor: Horace L. Shivers, 21 Filmore St., Trenton, N.J. 08638

[21] Appl. No.: 602,717

[22] Filed: Apr. 23, 1984

[51] Int. Cl.[4] ..... B65D 55/02

[52] U.S. Cl. ..... 215/230; 215/365

[58] Field of Search ..... 215/230, 366, 365, 203

[56] References Cited

U.S. PATENT DOCUMENTS 605,227 6/1898 Henry et al. ..... 215/366

881,945 3/1908 Perez ..... 215/365

*Primary Examiner*—Donald F. Norton

*Attorney, Agent, or Firm*—William Lawrence Muckelroy

[57] ABSTRACT

This invention relates to an improvement in a container for liquids or solids which container is made of either plastic or glass and wherein the improvement is a combination adapted to show any tampering with the container. The invention has as its principal object to provide a practical device of the indicated character wherein any tampering with or opening of the container will be shown by an indelible mark of ink made by movement of a ball on the inside wall of a transparent tube which is connected to the container and which indicates to a consumer any tampering with the container or the contents thereof.

10 Claims, 6 Drawing Figures

FIG. 4
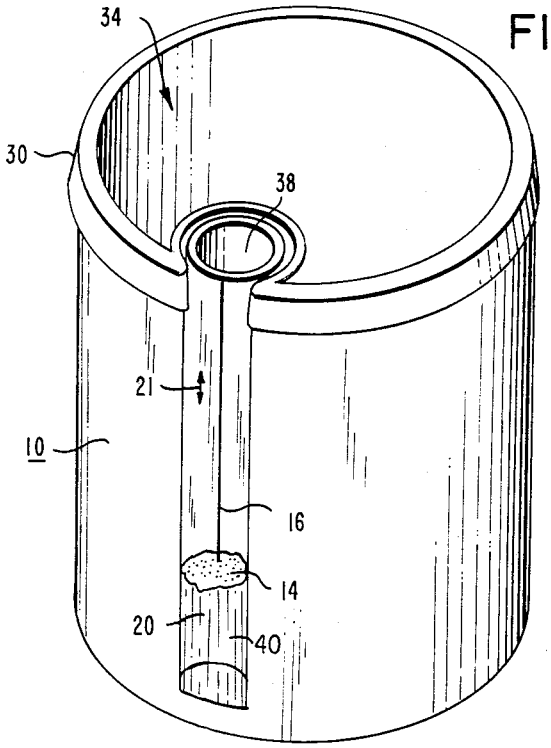
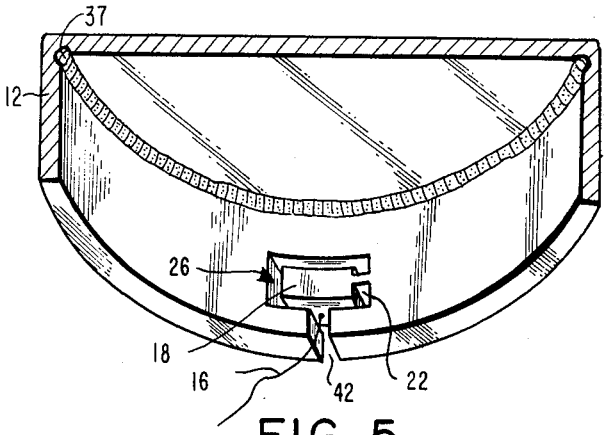
FIG. 5
FIG. 6
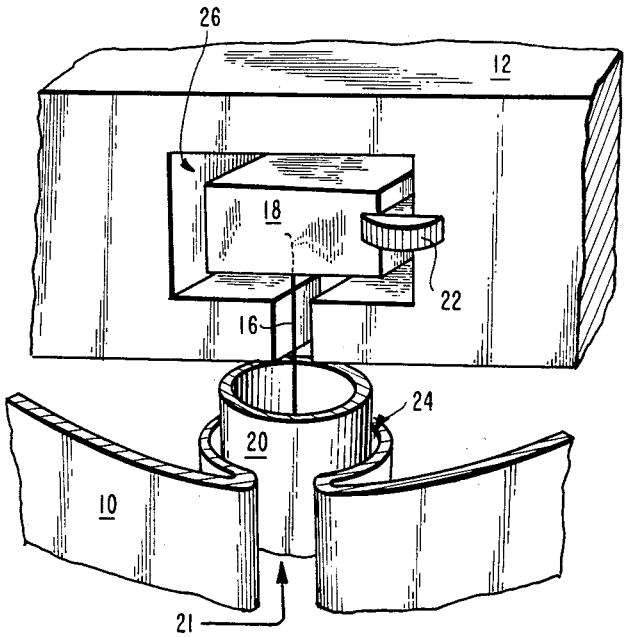

CONTAINER AND CLOSURE WITH TAMPER INDICATING MEANS

BACKGROUND OF THE INVENTION

1. Field of the Invention

The invention is generally related to means for opening or closing a container and providing an indication when said container has been opened or closed. The invention is specifically related to means for providing an indication of when a closed or sealed container has been tampered with.

2. Description of the Prior Art

In 1925 Samuel Schenkein received U.S. Pat. No. 1,539,431 for a bottle closure which was an invention concerning a means for securing the closure of a bottle with a cap and to prevent unauthorized opening of the bottle. His invention consisted of using a flexible member such as a cord or a wire through an opening in the cap with the other end of the member being provided with an enlargement such as a knot to prevent the member from being entirely drawn through the opening in the cap.

Lester L. Lewis in U.S. Pat. No. 2,263,882, issued in 1941, claimed an invention of a bottle with a closure that crushed a revenue stamp at the first opening of the bottle. The crushing is described as accomplished between a stopper and a member by means of an integral and unitary lifting rod. Similarly, Murray Kay in U.S. Pat. No. 2,066,889, issued in 1937, invented a non-refillable closure for containers wherein a valve element was incorporated into the closure means.

In 1940 Maurice Sanburg was issued U.S. Pat. Nos. 2,201,205 and 2,201,791 for a type of tamper proof closure for bottles designed to contain liquor or perfume. The Sanburg means for indicating tampering was an opaque band surrounding the neck of the bottle and a tamper indicating symbol on the container neck covered by said band such that when the band was removed the symbol on the container neck would become visible.

SUMMARY OF THE INVENTION

An improved combination of a closed bottle and a means for opening said bottle is provided wherein the improvement is the addition of a means for providing an indication of whether the means for opening said container have been either substituted or tampered with by a visible marking on the inside of a transparent cylindrical tube containing a ball of an absorbent material having indelible ink therein, wherein the ball is attached to a cap for the container by means of a string.

OBJECTS OF THE INVENTION

A primary purpose of this invention is to provide a safety bottle or container whereby medicines, drugs and other articles to be consumed by the public and purchased over the counter may be bottled whereby a positive indication of any tampering is provided.

A further object of this invention is to provide a container for medicines or the like whereby any tampering is indicated by means of an indelible ink marking inside of a clear tube. It is also an object of this invention to provide a means for indicating tampering of a bottle or container for medicine or the like whereby the means cannot be removed without removing the closure for said container or bottle.

These and other objects of the novel invention will become apparent to one of ordinary skill in the art from a reading of the foregoing description of the preferred embodiment in combination with the accompanying drawings wherein:

FIG. 4 is a perspective view of the novel invention with the closure portion thereof removed;

FIG. 5 is a partial perspective of the closure of the novel invention; and

FIG. 6 is a close-up and perspective view of the closure and container of the invention in combination.

DESCRIPTION OF THE PREFERRED EMBODIMENT

Figure 1:
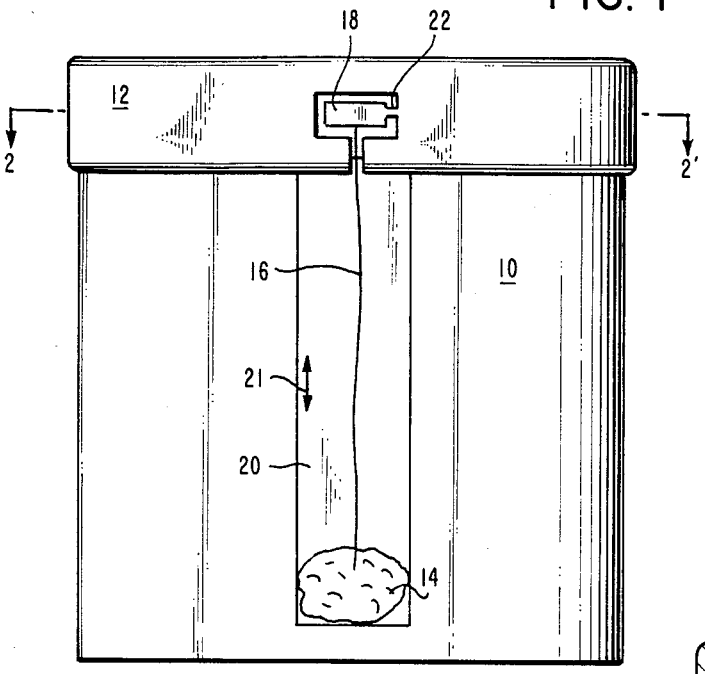
FIG. 1 is a side view of a container and closure incorporating the invention.

There is shown in FIG. 1 a container 10 partially covered and sealed by a closure 12. A ball 14 is connected to a string 16. The ball 14 is interconnected to a piece 18 of, for example, molded plastic. The ball 14 is housed inside a transparent tube 20 of glass or plastic, for example. The container 10 has a partially walled shaft 21. The tube 20 is adapted to fit inside the shaft 21.

The container 10 is made of glass, for example. The closure 12 is a plastic cap, for example, which is adapted to snap onto the container 10. The container 10 may be specifically adapted to be either a jar or a bottle or other container means.

The ball 14 is made of an absorbent material such as cotton soaked with a non drying ink, preferrably red in color, for example. The string 16 has a second end attached to the ball 14 and a first end which is attached to the piece 18 made of plastic, for example. The piece 18 has molded therein the second end of the string 16.

The piece 18 is integrally attached to the closure 12 and made a part thereof by means of a bridge 22. The bridge 22 is made of a material similar to the piece 18 and the closure 12. The closure 12, the piece 18 and the bridge 22 are all made of a class of material or materials such that by the application of energy to these parts via any of several energy delivery processes, such as laser beam, microwave heating, or conduction heating they meld together. The closure 12, the piece 18 and the bridge 22 form an integral member as is shown in FIG. 1.

Figure 2:
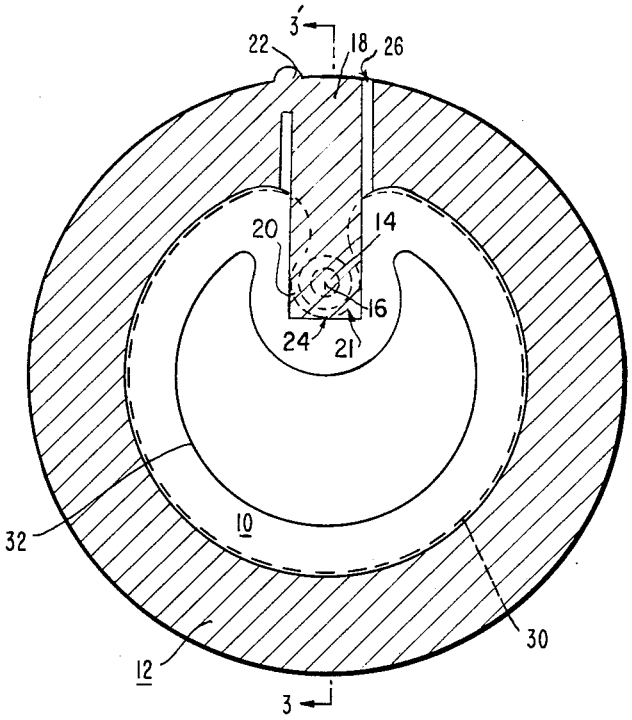
FIG. 2 is a cross sectional view of the container and closure taken at the plane 2—2' shown in FIG. 1.

Shown in FIG. 2 is a cross sectional plan view from the view of the plane 2—2' shown in FIG. 1. The closure 12 is shown in FIG. 2 surrounding the container 10. Both the closure 12 and the container 10 are illustrated with an exaggerated thickness. The container 10 has a lip 30 which secures the closure 12 to the container 10. This lip 30 located at the mouth 32 of the container 10 is an example of a means for securing the closure 12 to the container 10.

The ball 14 is connected to the piece 18 by the string 16. The tube 20 is shown inside, a cross section of the shaft 21 which is shown to be cylindrical in shape (in FIGS. 4 and 5), for example. Similarly, the tube 20 is also shown to be cylindrical in shape (in FIGS. 4 and 5). There is a space 24 between the outside of the cylindrical tube 20 and the shaft 21.

Figure 3:
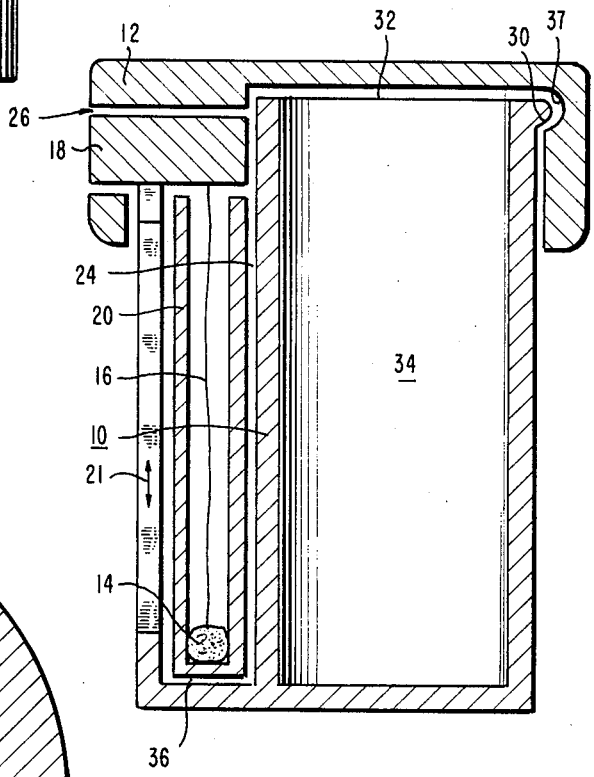
FIG. 3 is a cross sectional view of the container and closure shown in FIG. 1 taken at the plane 3—3' shown in FIG. 2.

A spatial plane 3—3' in FIG. 2 illustrates the plan view and cross section for FIG. 3.

The container 10 is shown in FIG. 3 closed by the closure 12, both of which are shown in cross section from the plane 3—3' of FIG. 2. FIG. 3 may be further characterized as a vertical cross section. Hence, piece 18 is shown in vertical cross section in relationship to the tube 20 and the cavity 26.

The closure 12 and the container 10, when together, form a plenum 34. A partially walled cylindrical shaft 21 with a bottom 36 is an integral part of the container 10, for example.

There is shown the ball 14 connected by the string 16 to the piece 18. The ball 14 is inside the tube 20 which fits inside the shaft 21 and forms a space 24 between the tube 20 and the shaft 21. The piece 18 is integrally connected to the closure 12. The closure 12 is retained on the container 10 by a means for closing the container 10 such as the lip 30, for example, located at the mouth 32 of the container 10. When the closure 12 is retained on the container 10 by engagement of the recess 37 with the lip 30 at the mouth 32 of the container 10 a plenum 34 is formed inside the container 10.

A plane 3—3' is illustrated in FIG. 2. This plane represents a horizontal cross section such as shown in FIG. 3.

In FIG. 4 there is a perspective view of the container 10 and the tube 20. Inside the tube 20 there is the ball 14 shown partially raised with the string 16 attached thereto. No closure is illustrated. The tube 20 has an aperture 38 through which the string 16 exits for attachment to the closure 12 (not shown).

Movement of the ball 14 up the tube 20 causes an indelible ink, preferrably red and soaked into the ball 14, to make a visible marking on the inside of the tube 20 which is visible to an outside observer (not shown) because of the transparency of the tube 20. A visible film 40 coats the inside of the tube 20 up to the location of the ball 14.

A vertical cross section of the closure 12 is shown in perspective in FIG. 5. Inside the closure 12 is the groove 37 which is adapted to clip over the lip 30 (not shown) of the container 10 (also not shown). The piece 18, made of molded plastic, for example, is attached to and forms a part of the closure 12. The piece 18 is attached by the bridge 22. The string 16 is molded into the piece 18 and is shown dangling from a slit 42 leading from the cavity 26. The string 16 is attached to the ball 14 (not shown).

In FIG. 6 there is shown a detailed and close-up perspective view of a portion of the outside of the closure 12 in the vicinity of the cavity 26 and piece 18. Also shown is the container 10 with the tube 20 inserted therein and partially exposed. The tube 20 fits inside the shaft 21 with the space 24 between the tube 20 and the walls of the container 10 which form the shaft 21. The string 16 is shown molded inside the piece 18. The piece 18 is attached to the closure 12 by an interconnecting means such as the bridge 22, for example, As the closure 12 is removed from the container 10 (shown in FIG. 6 with the top periphery cut away), the string 16 is in turn pulled up thereby raising the ball 14 which is soaked with indelible, non drying ink (not shown).

Although the foregoing specification describes a specific detailed and preferred embodiment of the invention, it is to be understood that various modifications may be developed by persons of ordinary skill in the art and that although such equivalents are not specifically described herein, they are nevertheless encompassed by this invention as a comparable means or combination for providing an indelible or permanent indication of tampering. Accordingly, the invention is particularly claimed in the following enumerated claims:

What is claimed is:

1. In combination with a closed bottle and means for opening said bottle, the improvement comprising:

an elongated member having a first end and a second end, said first end being attached to said means for opening said bottle;

a transparent enclosure having an interior wall, said enclosure being in contact with said bottle; and, means for visibly marking said enclosure located inside said enclosure and attached to said second end of said member, said means for visibly marking said enclosure being disposed inside said enclosure whereby removal of said means for opening said bottle visibly marks at least a part of the interior wall of said enclosure.

2. The combination of claim 1 wherein said bottle has a cavity opening to the outside thereof adapted to receive and retain said transparent enclosure.

3. The combination of claim 2 wherein said transparent enclosure is a tube, closed at one end, said closed end being a bottom.

4. The combination of claim 3 wherein said means for visibly marking said enclosure is movably located at the bottom of said enclosure.

5. The combination of claim 4 wherein said means for visibly marking said enclosure is a ball of matter having a non drying ink thereon.

6. The combination of claim 5 wherein said elongated member is comprised of string and wherein said string interconnects said ball and said means for opening said bottle.

7. The combination of claim 5 wherein said elongated member tautly interconnects said ball to said means for opening said bottle.

8. The combination of claim 6 wherein said means for opening said bottle comprises a cap removably attached to said bottle.

9. The combination of claim 8 further comprising a small piece of material wherein the first end of said member is molded into said material and wherein said material is melded to said cap.

10. The combination of claim 9 wherein said cap is made of plastic and said bottle and said tube are also made of plastic.

* * * * *